US005147071A

United States Patent [19]

Rutter et al.

[11] Patent Number: 5,147,071

[45] Date of Patent: Sep. 15, 1992

[54] COLLAPSIBLE BAG WITH EVACUATION PASSAGEWAY AND METHOD FOR MAKING THE SAME

[75] Inventors: Christopher C. Rutter, Oakland; James H. Rebholz, San Ramon, both of Calif.

[73] Assignee: The Coca-Cola Company, Atlanta, Ga.

[21] Appl. No.: 682,817

[22] Filed: Apr. 9, 1991

[51] Int. Cl.[5] ..... B65D 35/00

[52] U.S. Cl. ..... 222/92; 222/105; 383/906; 493/929

[58] Field of Search ..... 222/92, 95-96, 222/105, 107, 386.5, 464, 547; 383/219-220, 906; 493/213, 929

[56] References Cited

U.S. PATENT DOCUMENTS

| | | | |
|---|---|---|---|
| 2,891,700 | 6/1959 | Maynard | 222/92 |
| 3,081,911 | 3/1963 | Scholle | 222/107 |
| 4,524,458 | 6/1985 | Pongrass et al. | 222/105 X |
| 4,601,410 | 7/1986 | Bond | 222/105 X |
| 4,893,731 | 1/1990 | Richter | 222/105 X |
| 4,913,316 | 4/1990 | Richter | 222/105 X |
| 4,998,990 | 3/1991 | Richter et al. | 222/105 X |

FOREIGN PATENT DOCUMENTS

| | | | |
|---|---|---|---|
| 00868 | 2/1986 | World Int. Prop. O. | 222/105 |

*Primary Examiner*—Michael S. Huppert
*Assistant Examiner*—Kenneth DeRosa
*Attorney, Agent, or Firm*—Thomas R. Boston; W. Dexter Brooks

[57] ABSTRACT

A collapsible bag for use in containing and dispensing a liquid, such as in a bag-in-box arrangement, and a method for making the bag. Prior to sealing together two bag walls to form the bag, a one-piece spout and evacuation strip unit is attached to the outside surface of one bag wall and one or more openings are provided through the bag wall in liquid communication with a plurality of liquid channels in the strip. The two bag walls are then sealed together to form the bag and the evacuation strip provides liquid passageways for the liquid in the bag to flow to the spout to achieve complete withdrawal of the liquid from the bag as the bag collapses.

26 Claims, 8 Drawing Sheets

COLLAPSIBLE BAG WITH EVACUATION PASSAGEWAY AND METHOD FOR MAKING THE SAME

BACKGROUND OF THE INVENTION

The present invention relates to collapsible bags, of the type used in bag-in-box, for containing and dispensing liquids, such as post-mix, soft drink syrups, and to a method for making such bags. More particularly, this invention relates to such bags having syrup evacuation passageways accessible to the syrup to achieve complete withdrawal of the syrup from the bag as the bag collapses and regardless of how the bag and the bag spout are oriented.

Bags for bag-in-box containers are well-known (see for example, U.S. Pat. Nos. 4,601,410; 4,137,930; 4,138,036; 4,286,636; 3,171,571; and 2,859,899) and some include inserts placed inside of the bag to provide a passageway for complete withdrawal of the liquid from the bag as the bag collapses. Some of these inserts, such as dip tubes, are inserted into the bag after the bag is made and after it is filled with liquid and have the disadvantage of the added time and expense to carry out this separate, additional task. To avoid this disadvantage, inserts were subsequently made part of the bag. Such inserts are placed between the bag walls and attached to the spout before the bag walls are joined to form the bag. However, these bags are subject to the disadvantages of the added time, expense and difficulty of positioning these inserts between the bag walls and also of then securing the inserts to the spout. In addition, some of these inserts, being adjacent or under the spout can interfere with or slow down the filling process. Another disadvantage is the possibility of these inserts become detached from the spout. U.S. Pat. No. 4,893,731 overcomes these disadvantages by placing an insert outside of the bag adjacent to the spout and along the bag wall and providing syrup evacuation passageways by forming the bag wall up into channels in the insert. However, when the bag wall is moved up into the insert channels, wrinkles occur in the bag wall which can cause problems in providing a seal at the periphery of the bag walls.

It is an object of the present invention to provide an improved bag and method for making the bag that overcomes many of the disadvantages in the prior art.

It is another object of this invention to provide such a bag with a liquid evacuation passageway without the necessity of a separate step to insert or attach it.

It is a still further object of this invention to provide a bag and method for making the bag which provides a passageway in liquid communication with the spout opening, without having to attach an insert to the spout and without having to insert anything into the bag.

It is a still further object of this invention to provide such a bag and method for making the same which bag and method are less expensive than that of the prior art.

It is another object of this invention to provide such a bag which can be filled easier and faster, which provides no restriction at the spout, and which has no insert that can be accidentally detached.

It is a further object of this invention to provide a method for making such a bag that can operate at a higher speed.

It is a still further object of this invention to provide a bag with an evacuation strip that is an integral one-piece unit with the bag spout.

It is a further object of this invention to provide a bag with an external evacuation strip and to provide the strip channels as liquid evacuation passageways without deforming or wrinkling the bag wall.

It is another object of this invention to provide a bag with an evacuation strip that is easier to and less expensive to manufacture and that provides better performance.

SUMMARY OF THE INVENTION

A collapsible bag for containing and dispensing a liquid, such as a post-mix soft drink syrup, and a method for making the bag. The bag is particularly useful in the bag-in-box system. The bag includes a one-piece spout and evacuation strip sealed to a bag wall. The evacuation strip has at least one elongated channel or groove therein. One or more openings are provided through the adjacent bag wall to provide at least one liquid passageway for syrup to be evacuated from inside of the bag to inside of the spout. The liquid passageway is in liquid communication with the spout. The channels in the strip are of such size and shape that as the bag collapses, the bag wall(s) cannot collapse into and close these liquid passageways, whereby the passageways permit and achieve complete withdrawal of the liquid from the bag as the bag collapses. The evacuation strip is integrally connected to one side of the spout, at which location the spout has a side opening in liquid flow communication with the channels or passageways in the strip. The spout has the normal spout opening. The one or more openings provided through the bag wall adjacent to the channels in the strip can be separate, spaced-apart holes or slits, for example.

The method of this invention includes, in the preferred embodiment, heat sealing a flat peripheral flange of the one-piece spout and strip unit to the outside surface of the bag, before all of the bag walls are joined together to form the bag. One or more openings are provided through the bag wall for the liquid to flow from the bag chamber into the channels in the strip. Such opening(s) can be made either before or after the flat flange is sealed to the bag.

BRIEF DESCRIPTION OF THE DRAWINGS

The present invention will be more fully understood from the detailed description below when read in connection with the accompanying drawings wherein like reference numerals refer to like elements and wherein:

FIG. 21 is a partly diagrammatic, partly schematic diagram showing a preferred method of manufacturing the bag of this invention.

DETAILED DESCRIPTION OF THE PREFERRED EMBODIMENT

Figure 1:
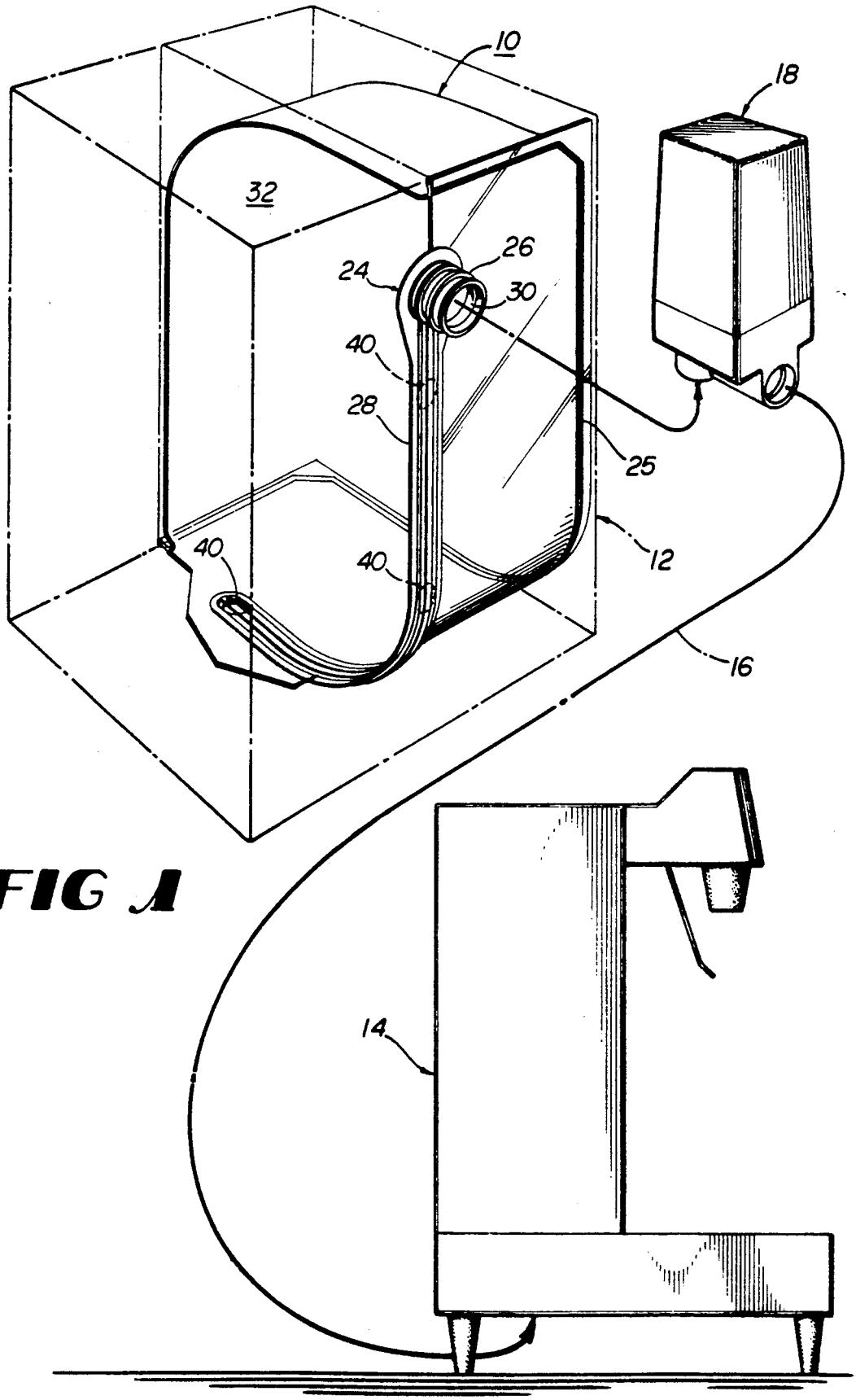
FIG. 1 is a partly diagrammatic, partly broken away perspective view of an overall arrangement in which the bag of the present invention can be used.

With reference now to the drawings, FIG. 1 shows a typical arrangement in which a bag 10 of the present invention can be used. The bag 10 is contained in a paperboard box 12 (this arrangement is known as bag-in-box) and supplies liquid, such as soft drink syrup, to a post-mix, countertop, beverage dispenser 14 through a syrup conduit or line 16 via a syrup pump 18.

Figure 16:
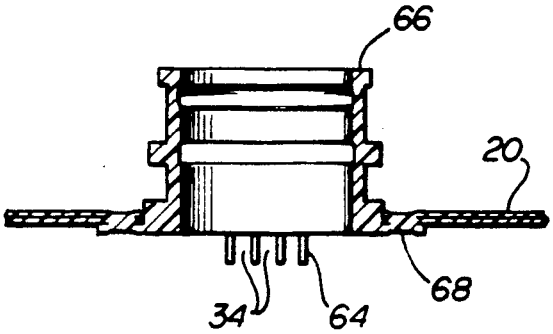
FIG. 16 is a cross-sectional view taken along line 16—16 of FIG. 15.

As the syrup is withdrawn, the bag 10 collapses (see FIG. 16). It is desirable to be able to put the bag in any orientation (such as with a spout 26 adjacent the top as shown in FIG. 1) and still have substantially all of the liquid dispensed from the bag leaving little or no liquid remnant. The present invention provides this advantage.

FIGS. 1-7 show the collapsible bag 10 according to one embodiment of the present invention including a pair of liquid-tight, flexible bag walls 20 and 22, joined (as by heat sealing) at their periphery 25, a one-piece, spout-evacuation strip unit 24 joined (preferably by heat sealing) preferably to the outside surface of one bag wall 20 along a peripheral flange 29 of the unit 24 and one or more openings 40 through the bag wall 20 to provide liquid passages from the bag chamber 32 into the strip passageways 36. The unit 24 includes a spout 26 and an integral evacuation strip 28. The spout 26 includes a spout opening 30 therethrough in liquid communication with the syrup chamber 32 inside of the bag 10 through a discharge opening 21 in the bag wall 20. The elongated evacuation strip 28 extends from a proximal end thereof in contact with the spout 26 to a distal end remote therefrom. Throughout the present specification and claims, the "inside surface" of the bag wall 20 is the surface facing into the bag chamber 32 and the "outside surface" is the other or outer surface thereof.

The strip 28 includes a plurality of straight, elongated, channels 34. These channels provide syrup evacuating passageways 36 (see FIG. 19) which cooperate with the openings 40 to provide syrup passageways for the syrup to flow from the bag chamber 32 to the spout opening 30, even as the bag 10 collapses. The passageways 36 have a depth and a width such that as the bag walls collapse during the dispensing of liquid from the bag, the bag wall 22 (or even 20) cannot collapse into and block the liquid flow through the passageways 36, such that these passageways remain open and permit and achieve complete withdrawal of the liquid from the bag as the bag collapses.

In the first embodiment shown in FIGS. 1-7, the openings 40 are circular openings about one-fourth inch in diameter. There are three such openings 40 spaced apart along the length of the strip 28. Additional openings can be provided if desired, and they can be of different sizes and shapes.

Figure 2:
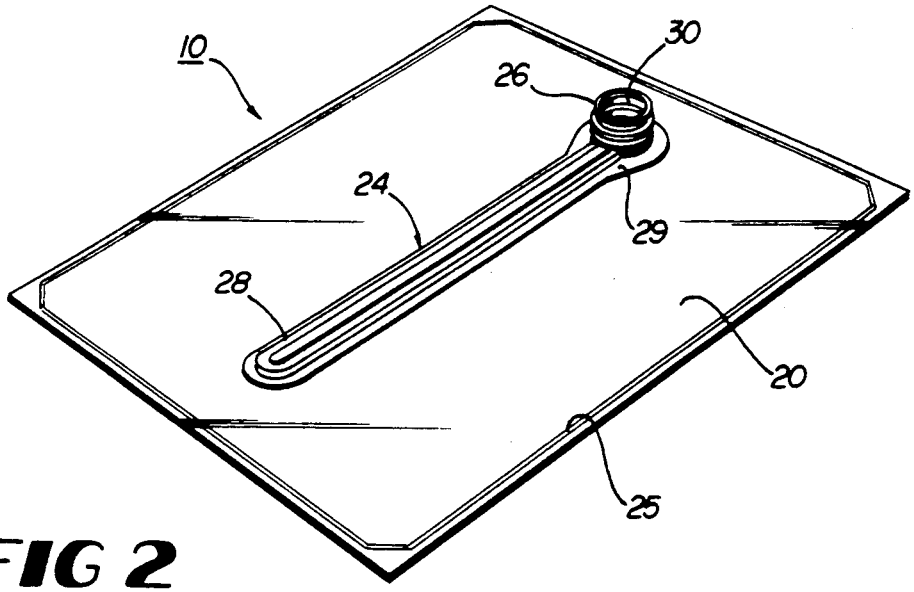
FIG. 2 is a perspective, top view of a bag of a preferred embodiment of the present invention.
Figure 3:
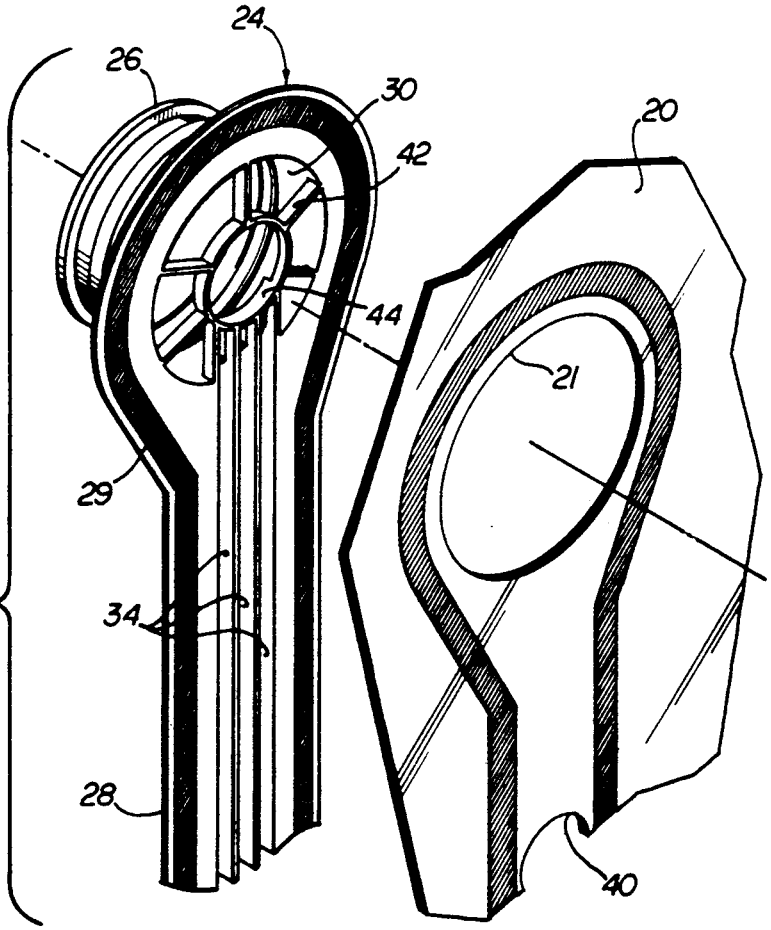
FIG. 3 is an enlarged, partial, exploded, perspective view of the bottom of the one-piece spout and evacuation strip of the present invention.
Figure 4:
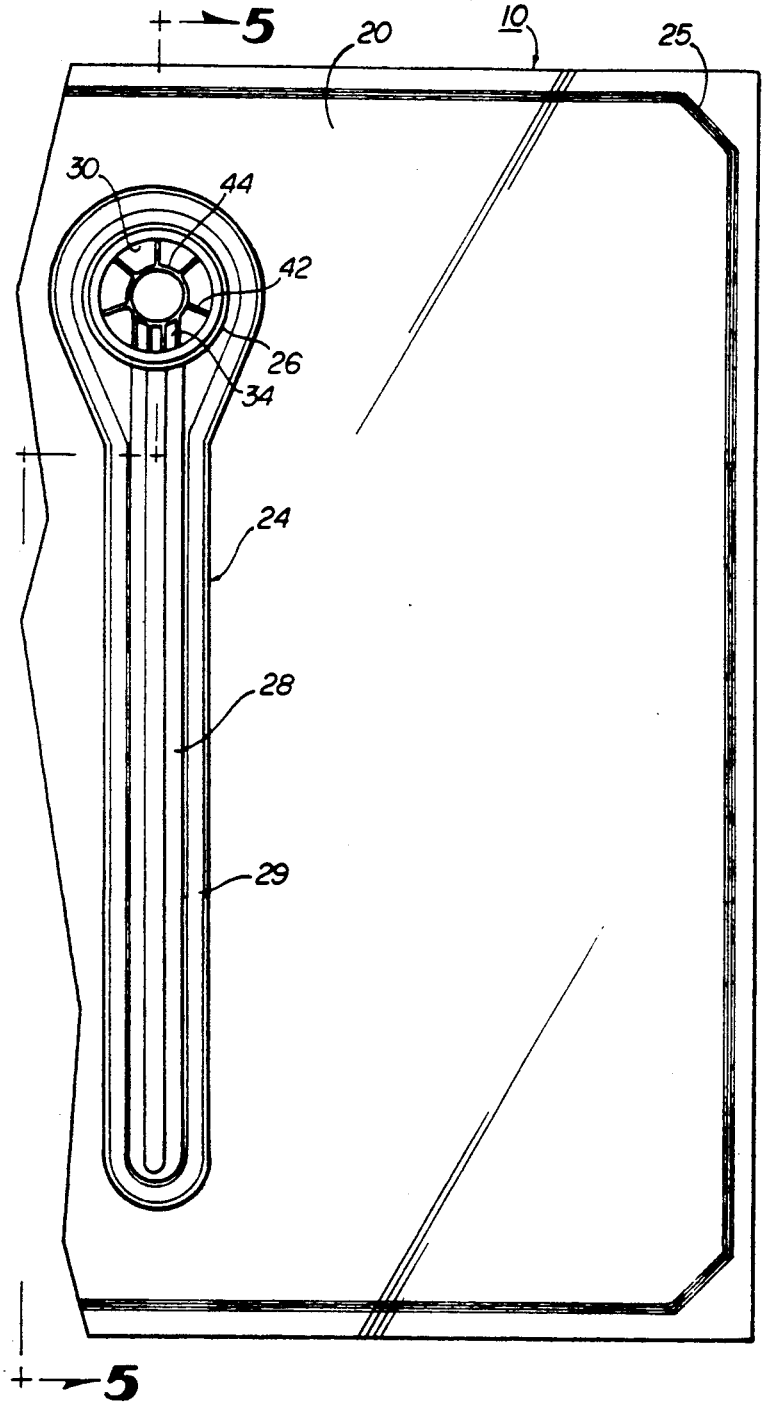
FIG. 4 is a partial plan view of the bag of FIG. 1.
Figure 5:
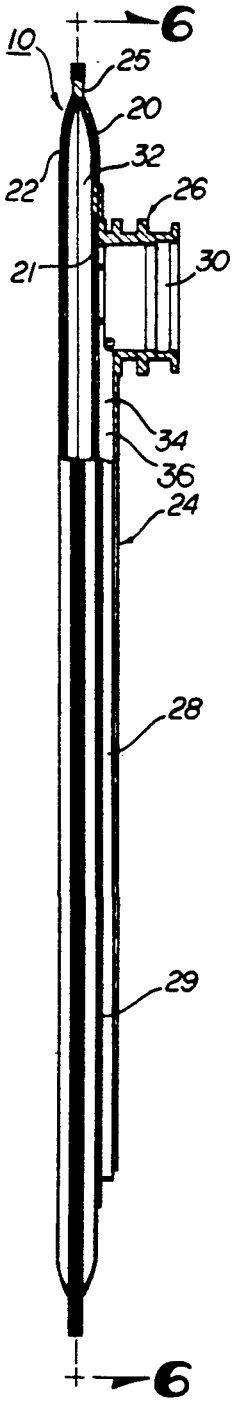
FIG. 5 is a partial, cross-sectional view taken along line 5—5 of FIG. 4.

FIG. 2 shows the finished bag 10 with the unit 24 attached and with the bag flat as it appears prior to filling with syrup. FIG. 3 is a partial view of the bottom of the unit 24 showing the spout 26 and part of the strip 28, exploded away from the bag wall 20 to which it is heat sealed. The shaded area in FIG. 3 shows the location of the heat sealing along the peripheral flange 29 of the unit 24. As shown in FIG. 3, the spout 26 includes a plurality of radial spider arms 42 and a ring 44 which assist in preventing the opposite bag wall 22 (or even 20) from being sucked into and blocking the spout opening 30. The spider arms 42 and ring 44 can alternatively be formed so as to extend axially further toward the opposite wall 22, if desired, to prevent blockage. Also, other shapes of elements can be used in place of the ring and spider arms shown.

Figure 6:
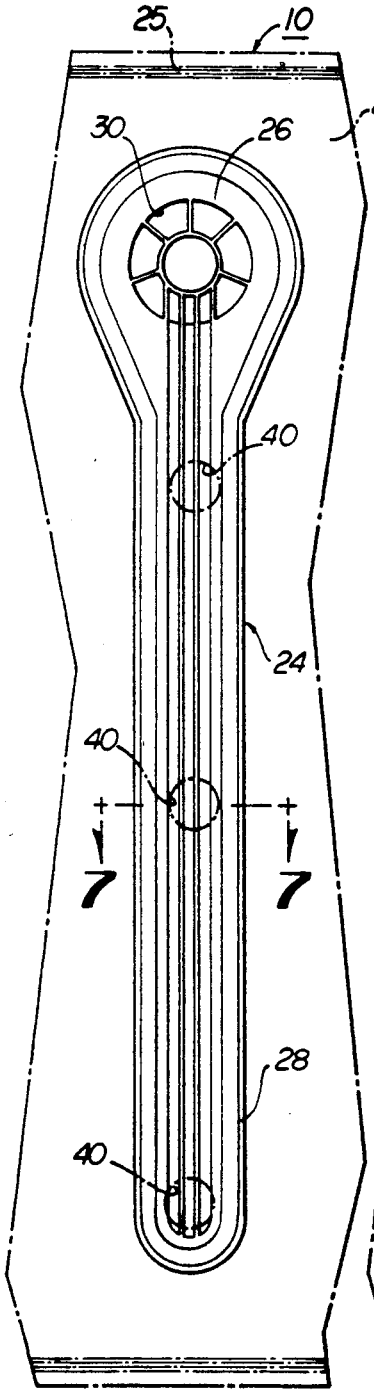
FIG. 6 is a partial, top plan view of the bag of FIG. 1.
Figure 7:
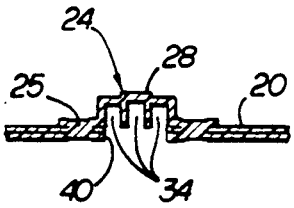
FIG. 7 is a partial, cross-sectional view taken along line 7—7 of FIG. 6.

FIGS. 6 and 7 show a portion of the bag 10 including the unit 24 sealed to the bag wall 20. FIG. 7 is a cross-sectional view along line 7—7 of FIG. 6 showing the opening 40 providing liquid communication to the channels 34.

Figure 8:
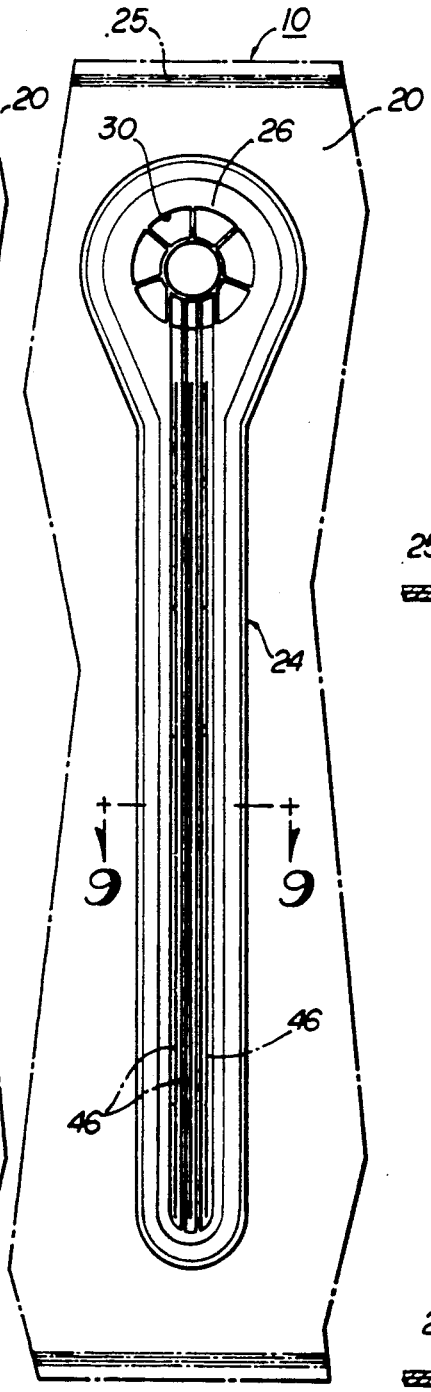
FIG. 8 is a partial top plan view of a second embodiment of the bag of the present invention.
Figure 9:
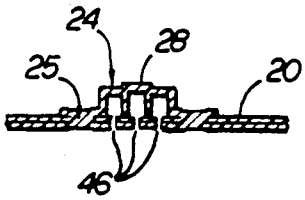
FIG. 9 is a partial, cross-sectional view taken along line 9—9 of FIG. 8.

FIGS. 8 and 9 show a second embodiment of the invention in which, instead of separate openings 40, the bag wall 20 is provided with one or more slits, such as three slits 46, one under each of the channels 34. The slit can be a single cut through the wall 20 (meaning through all of the layers of the wall 20 if it is a multilayered wall) or it can be a slot with some width of the wall material removed.

Figure 10:
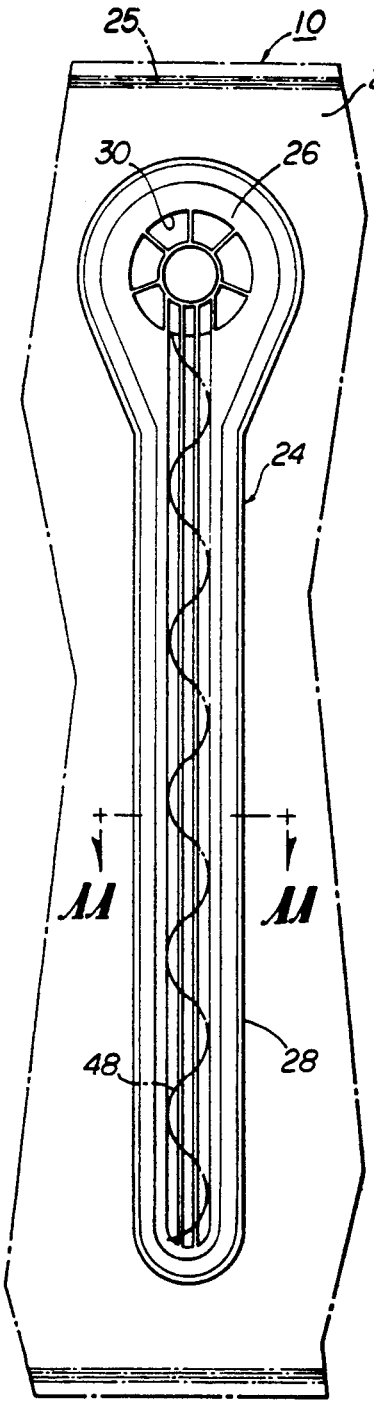
FIG. 10 is a partial, top plan view of a third embodiment of the bag of the present invention.
Figure 11:
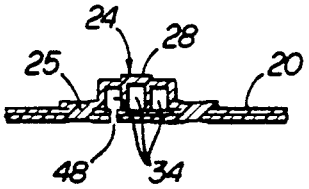
FIG. 11 is a partial, cross-sectional view taken along line 11—11 of FIG. 10.

FIGS. 10 and 11 show a third embodiment in which the opening is a single wavy slit 48. The opening 40 and the slits 46 and 48 are preferably (although not necessarily) made in the bag wall 20 prior to attaching the unit 24 thereto.

Figure 12:
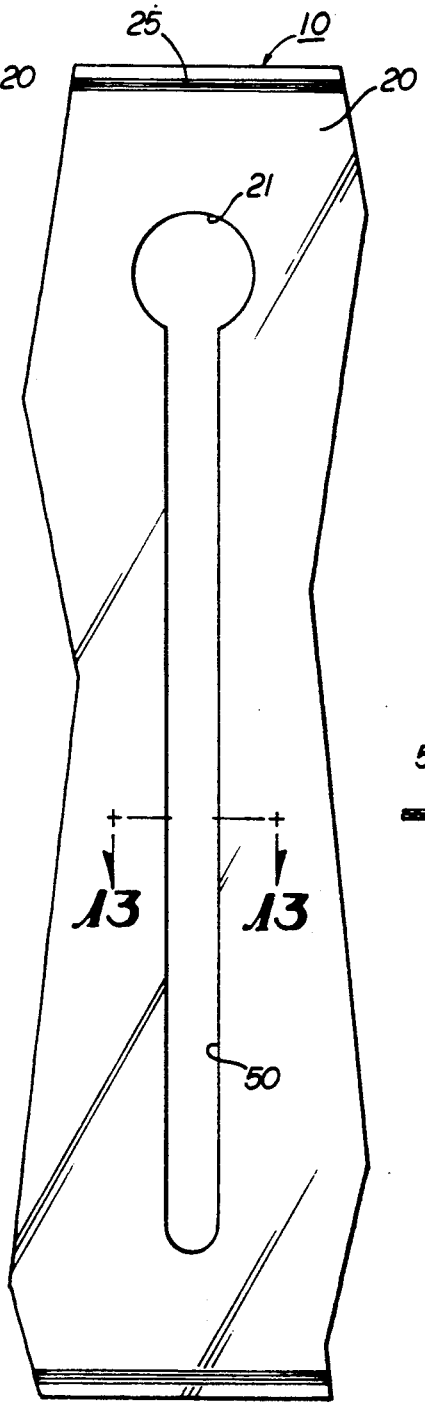
FIG. 12 is a partial plan view of a bag wall with a cut-out portion according to one embodiment of this invention.
Figure 13:
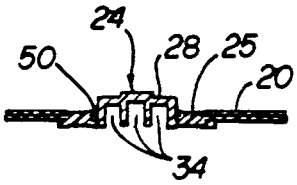
FIG. 13 is a partial cross-sectional view taken along line 13—13 of FIG. 12.
Figure 14:
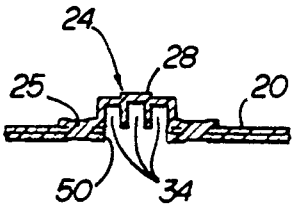
FIG. 14 is a partial cross-sectional view similar to FIG. 13 but of another embodiment.

FIG. 12 shows another embodiment of the present invention and shows a plan view of a portion of the wall 20 showing a cut-out 50. FIG. 13 shows the unit 24 installed in the cut-out area with the peripheral flange 25 sealed to the bottom surface (the inside of the bag surface) of the wall 20. FIG. 14 is similar to FIG. 13 except that the unit 24 is sealed to the outside surface of the wall 20.

Figure 15:
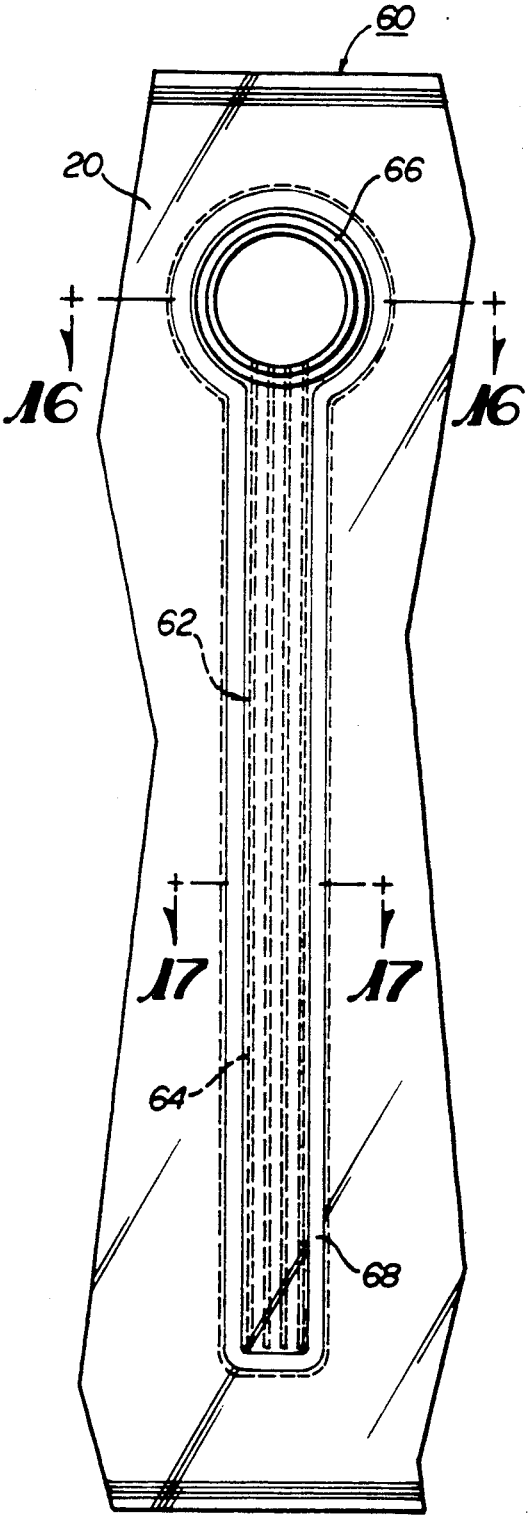
FIG. 15 is a partial, top plan view of a portion of the bag wall 20 with another embodiment of the spout and evacuation strip unit.
Figure 17:
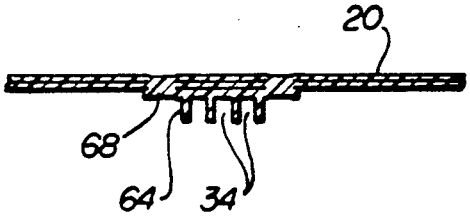
FIG. 17 is a cross-sectional view taken along line 17—17 of FIG. 15.

FIGS. 15-17 show another embodiment of the present invention of a bag 60 having a one-piece spout and evacuation strip unit 62 sealed thereto. In this embodiment, the strip 64 is attached to the inside surface of the bag wall 20; thus, no openings are required to be made through the bag wall 20 to provide liquid communication into the channels 34. The spout 66 extends up from the peripheral sealing flange 68 and the strip extends down from the flange.

Figure 18:
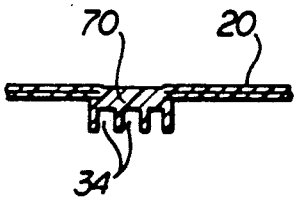
FIG. 18 is a cross-sectional view similar to FIG. 17 but showing another embodiment of the evacuation strip.

FIG. 18 shows an alternative embodiment to that of FIG. 17 in that the sealing flange is omitted from the strip 64 portion of the unit 62. The flat bottom wall 70 of the strip 64 is sealed to the wall 20. In FIGS. 17 and 18, the evacuation strip can be tubular (with any cross-sectional shape, such as square or circular) with holes in it, rather than having U-shaped channels. In FIGS. 17 and 18, the proximal end of the channels are in liquid communication with the spout opening without the need for a side opening in the spout as shown in FIG. 3. Clearly, the unit of this invention avoids any sharp angles to avoid damage to the bag.

Figure 19:
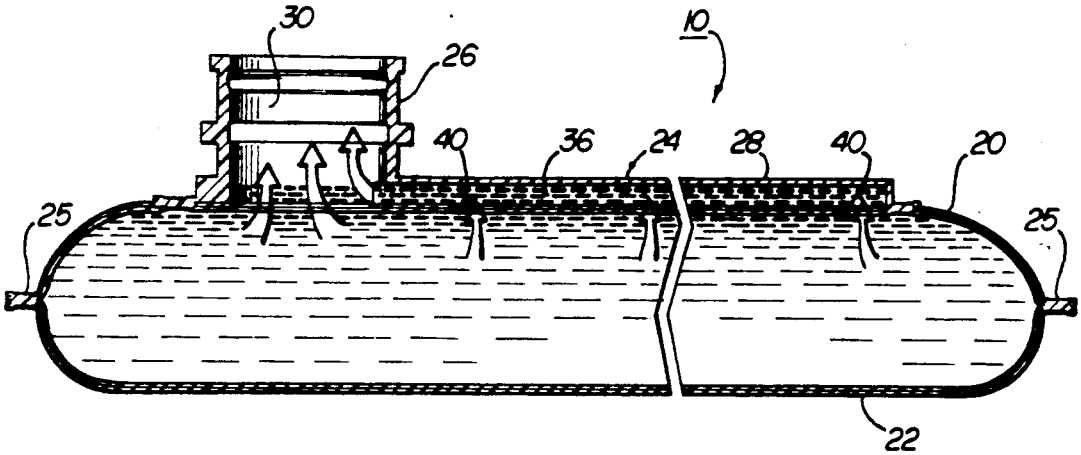
FIG. 19 is a partly diagrammatic, cross-sectional view through the bag of this invention showing the syrup flow during evacuation.
Figure 20:
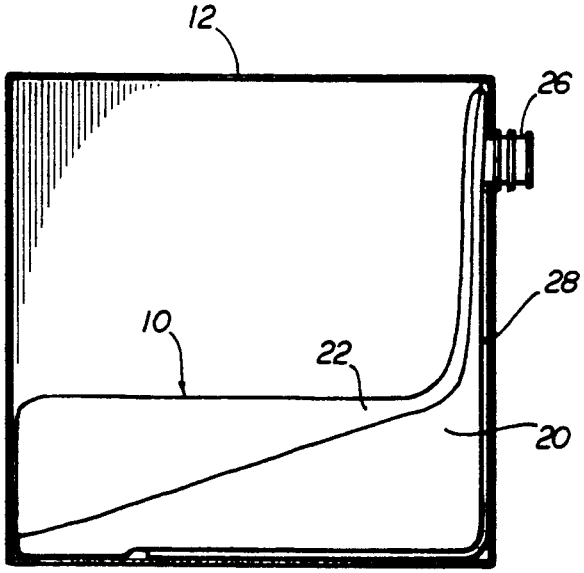
FIG. 20 is a cross-sectional view through the bag-in-box of FIG. 1 illustrating the bag after it has been partly evacuated.
Figure 2A:
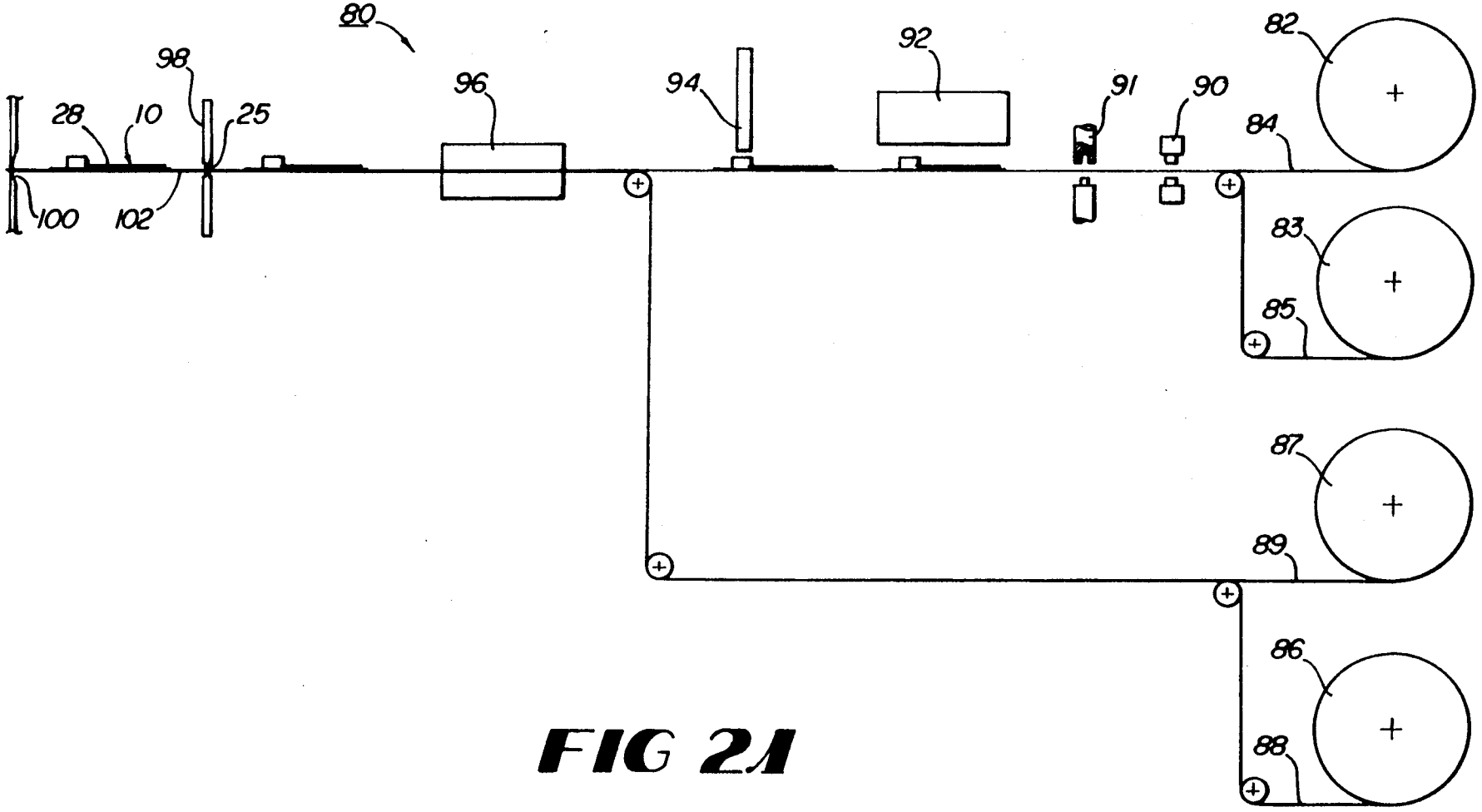

FIG. 19 diagrammatically illustrates the syrup flow out of the bag 10 of FIG. 1 including flow directly through the spout opening 30 and flow through the openings 40, then through the liquid passageways 36 in the channels 34 and then into the spout opening 30. FIG. 20 illustrates the bag 10 in a box 12 after the bag has been partially evacuated. Even though the wall 22 has collapsed against wall 20 at the upper ends thereof, syrup can still be withdrawn from the bag 10 because of the liquid passageways 36 through the channels 34 which remain open and which continue to provide an evacuation avenue for the syrup.

FIG. 21 illustrates a method of making the bag 10 according to the present invention. FIG. 21 shows a manufacturing system 80 including a pair of rolls 82 and 83 supplying layers 84 and 85 of material to make bag wall 20, a pair of rolls 86 and 87 supplying layers 88 and 89 of material to make bag wall 22, a spout hole cutter 90, an evacuation opening cutter 91 (to cut openings 40 or slits 46 or 48), a unit sealer 92, a valve inserter 94, a side sealer 96 for sealing the side edges of the bag 10, an end sealer 98 for sealing the end edges of the bag 10, and a perforator 100 for providing perforations between each bag 10 in the continuous web 102 of bags. The unit sealer 92 also holds a supply of the units 24 to be sealed to the wall 20. The valve inserter 94 inserts a known valve into the spout opening 30 as is known in the art.

The unit 24 of this invention is preferably made of LLDPE having a thickness of 20 mil. However, other thicknesses and other materials can be used. It is preferably heat sealed to the wall 20 but it can be sealed in other ways. The bag walls are preferably plastic. The flexible wall layers may comprise any desired number of layers, although two are preferred. Layers 85 and 89 are preferably a web of 2 mil. Polyethelene disposed adjacent to the layers 84 and 88 which are preferably a coextruded web made up of the following three materials: 2 mil polyethelene, ½ mil. Nylon, and 2 mil. polyethelene. The size and shape of the passageways are such as to prevent the bag wall 22 from collapsing thereinto and closing off the passageways. The dimensions depend, for example, on the stiffness of the bag wall. For example, the passageways can have a width of about 150 mil and a depth of about 120 mil.

While the preferred embodiment of this invention has been described above in detail, it is to be understood that variations and modifications can be made therein without departing from the spirit and scope of the present invention. For example, while only one evacuation strip has been shown, two or more can be used, if desired, extending in different directions from the spout 26. Other shapes, widths and lengths of the strip 28 can be used. Other shapes and numbers of channels (and passageways) can be used. Other materials can be used. Other numbers of bag wall layers (such as 1, 3 etc.) can be used. Other ways of sealing the unit 24 to the wall 20 can be used. The method can use continuous or intermittent movement. The bag is preferably formed by joining two separate rectangular bag walls together, however, other numbers of bag walls can be joined together to form the bag. The unit 24 is preferably connected to a bag wall before all of the walls are joined to form the bag, however, this is not essential. The unit 24 is preferably one-piece, however, two separate pieces could be used, if desired, and later heat sealed together or even left separate but adjacent, and the spout can in that case have an internal side extension channel to provide liquid communication with the strip channels. The evacuation strip can be attached to the inside or outside surface of the bag wall 20. If the evacuation strip is separate from the spout, it can alternatively be sealed to the other bag wall 22 and run directly underneath the spout.

We claim:

1. A collapsible bag for use in containing and dispensing a liquid comprising:

(a) a liquid tight bag having a flexible bag wall having a discharge opening therethrough and enclosing a liquid chamber;

(b) a one-piece spout and elongated evacuation strip unit sealed to an outside surface of said bag wall;

(c) said spout and strip unit including a spout overlying said discharge opening and having an axial spout opening extending axially therethrough in liquid communication with said chamber through said discharge opening and said spout having a sidewall opening into said axial spout opening, and said strip unit having a proximal end thereof in contact with said spout and extending to a distal end remote from said spout, said strip unit including an elongated liquid channel, said proximal end of said strip unit contacting said spout adjacent said sidewall opening and said channel being in liquid communication with said spout opening through said sidewall opening, said spout and strip unit including a flat peripheral sealing flange sealed to said outside surface of said bag; and (d) said bag wall having at least one opening therethrough underlying said channel providing liquid communication between said liquid chamber and said channel, said channel and said at least one opening providing a liquid passageway from inside of said bag to said spout opening, said channel and said opening having dimensions such that as said bag wall collapses during dispensing of liquid from the bag, the bag wall cannot collapse into and block said passageway, such that said passageway remains open to achieve substantially complete withdrawal of liquid from said bag as said bag collapses.

2. The bag as recited in claim 1 wherein said evacuation strip includes a plurality of said elongated channels providing a plurality of said passageways.

3. The bag as recited in claim 2 wherein each of said channels have a constant cross-sectional area throughout their length.

4. The bag as recited in claim 2 wherein all of said channels extend substantially the entire length of said evacuation strip.

5. The bag as recited in claim 2 wherein said spout includes an openwork structure of spider arms at its lower end such that the bag wall opposite to said spout cannot collapse into and seal off said spout opening.

6. The bag as recited in claim 2 wherein said bag wall includes a pair of bag walls sealed at their peripheries.

7. The bag as recited in claim 2 wherein said strip is flexible and straight.

8. The bag as recited in claim 2 wherein said spout is located adjacent to one edge of said bag.

9. The bag as recited in claim 2 wherein said channels terminate short of a distal end of said strip to eliminate any sharp edges.

10. The bag as recited in claim 2 wherein said spout and strip unit is heat sealed to said bag wall.

11. The bag as recited in claim 2 wherein said spout and strip unit is made of linear low density polyethylene.

12. A method for making a collapsible bag for use in containing and dispensing a liquid comprising the steps of:

(a) sealing a pair of bag walls together to form a collapsible bag with a liquid tight, flexible, bag wall enclosing a liquid chamber;

(b) prior to said sealing step, forming a discharge opening through one of said bag walls and attaching a one-piece spout and elongated evacuation strip unit to an outside surface of said one of said bag walls with said spout having a spout opening extending axially therethrough in liquid communication with said liquid chamber through said discharge opening, said strip unit having a proximal end in contact with said spout and extending to a distal end remote from said spout, said strip unit including an elongated channel; and (c) forming at least one opening through said one of said bag walls underlying said channel to provide a liquid communication passageway between said liquid chamber and said spout opening.

13. The method as recited in claim 12 including the step of providing said strip with a plurality of said channels to provide a plurality of said passageways and wherein said forming step includes providing a plurality of spaced-apart openings through said one of said bag walls.

14. The method as recited in claim 12 including the step of providing said strip with a plurality of said channels to provide a plurality of said passageways and wherein said forming step includes providing a single elongated slit underneath each of said channels.

15. A collapsible bag for use in containing and dispensing a liquid comprising:

(a) a liquid tight bag having a flexible bag wall having a discharge opening therethrough and enclosing a liquid chamber;

(b) a one-piece spout and elongated evacuation strip unit sealed to said bag wall;

(c) said spout and strip unit including a spout overlying said discharge opening and having an axial spout opening extending axially therethrough in liquid communication with said chamber, and said strip unit having a proximal end in contact with said spout and extending longitudinally to a distal end remote from said spout, said strip unit including therein at least one elongated liquid channel in liquid communication with said spout opening; and (d) at least one opening providing fluid communication between said liquid chamber and said at least one channel, to provide a liquid passageway for liquid to flow out of said bag, said channel and said at least one opening having dimensions such that as said bag wall collapses during evacuation of liquid from said bag, said bag wall cannot collapse into and block said passageway, such that said passageway remains open to achieve substantially complete withdrawal of liquid from said bag as said bag collapses.

16. The bag as recited in claim 15 wherein said strip includes a plurality of elongated channels providing a plurality of said passageways.

17. The bag as recited in claim 16 wherein said spout includes a side opening into said spout opening and said channels are in liquid communication with said spout opening through said side opening.

18. The bag as recited in claim 15 wherein said strip is flexible and straight.

19. The bag as recited in claim 15 wherein said channels terminate short of a distal end of said strip to eliminate any sharp edges.

20. The bag as recited in claim 15 wherein said strip is sealed to an inside surface of said bag wall, and said at least one opening is an opening in said strip into said at least one channel.

21. The bag as recited in claim 15 wherein said strip is sealed to an outside surface of said bag, and said at least one opening is an opening through said bag wall and said at least one channel is U-shaped.

22. A collapsible bag for use in containing and dispensing a liquid comprising:

(a) a liquid tight bag having a flexible bag cell having a discharge opening therethrough and enclosing a liquid chamber;

(b) a spout sealed to said bag wall and an elongated evacuation strip unit sealed along the entire length of said strip unit to said bag wall;

(c) said spout overlying said discharge opening and having an axial spout opening extending axially therethrough in liquid communication with said chamber through said discharge opening, and said strip unit having a proximal end in contact with said spout and extending to a distal end remote from said spout, said strip unit including therein at least one elongated liquid channel in liquid communication with said spout opening; and (d) at least one opening providing fluid communication between said liquid chamber and said at least one channel to provide a liquid passageway for liquid to flow out of said bag, said channel and said at least one opening having dimensions such that as said bag wall collapses during evacuation of liquid from said bag, said bag wall cannot collapse into and block said passageway, such that said passageway remains open to achieve substantially complete withdrawal of liquid from said bag as said bag collapses.

23. The bag as recited in claim 22 wherein said spout and strip are a one-piece integral unit.

24. The bag as recited in claim 22 wherein said strip is sealed to the outside surface of said bag and said at least one opening is an opening through said bag wall underlying said at least one channel.

25. The bag as recited in claim 22 wherein said strip is sealed to the inside surface of said bag wall and said at least one opening is an opening in said strip.

26. The bag as recited in claim 25 wherein said strip is sealed to the same bag wall to which said spout is sealed.

* * * * *

UNITED STATES PATENT AND TRADEMARK OFFICE

CERTIFICATE OF CORRECTION

PATENT NO. : 5,147,071

DATED : September 15, 1992

INVENTOR(S) : Christopher C. Rutter et al.

It is certified that error appears in the above-identified patent and that said Letters Patent is hereby corrected as shown below:

Column 8, line 31

In claim 22, line 3, delete "cell" and insert --wall-- therefor.

Signed and Sealed this

Twenty-sixth Day of October, 1993

*Attest:*

Bruce Lehman

BRUCE LEHMAN

*Attesting Officer*

*Commissioner of Patents and Trademarks*